United States Patent [19]

Curtis

[11] 3,941,554

[45] Mar. 2, 1976

[54] COMBINATION LANTERN, REGULATOR-VALVE, AND HIGH PRESSURE PROPANE CYLINDER

[75] Inventor: Richard D. Curtis, Wichita, Kans.

[73] Assignee: The Coleman Company, Inc., Wichita, Kans.

[22] Filed: July 11, 1974

[21] Appl. No.: 487,607

Related U.S. Application Data

[63] Continuation of Ser. No. 329,879, Feb. 5, 1973, abandoned.

[52] U.S. Cl. ..... 431/89; 431/109; 137/505.42

[51] Int. Cl.[2] ..... F23H 1/00; F21H 7/00

[58] Field of Search ..... 431/89, 100, 109, 344; 137/505.42

[56] References Cited

UNITED STATES PATENTS

| | | | |
|---|---|---|---|
| 2,586,037 | 6/1971 | Zimmer | 137/505.18 |
| 2,793,504 | 5/1957 | Webster | 431/304 |
| 2,796,753 | 6/1957 | Wallgren | 431/344 |
| 2,854,991 | 10/1958 | Webster | 137/504.42 |
| 3,143,107 | 8/1964 | Lindgren | 431/344 |
| 3,699,998 | 10/1972 | Baranowski | 137/505.42 |
| 3,812,877 | 5/1974 | Fleischhacker et al. | 137/505.42 |

*Primary Examiner*—Carroll B. Dority, Jr.
*Attorney, Agent, or Firm*—Dawson, Tilton, Fallon & Lungmus

[57] ABSTRACT

A combination propane lantern, pressure regulator-valve, and pressurized propane fuel container in which the lantern is supported by the regulator-valve and the propane container, and the rate at which fuel is delivered to the lantern remains substantially constant and independent of pressure within the propane cylinder and ambient temperature. The lantern includes a burner assembly which extends upwardly from the base of the lantern, and the regulator-valve is connected to the burner assembly. The regulator-valve housing is provided with an internally threaded recess into which the connector fitting of the propane container is screwed, and the container thereby supports the regulator-valve and the lantern. The regulator-valve includes a rotatable adjusting knob which can be used to vary the fuel flow through the regulator-valve between fully closed and fully opened positions and therefore also serves as an on-off valve.

1 Claim, 8 Drawing Figures

COMBINATION LANTERN, REGULATOR-VALVE, AND HIGH PRESSURE PROPANE CYLINDER

RELATED APPLICATION

This is a continuation application of copending, co-owned application Ser. No. 329,879, filed Feb. 5, 1973.

BACKGROUND

This invention relates to a propane lantern and, more particularly, to a propane lantern in which a pressure regulator functions both as a fuel regulator and an on-off valve and supports the lantern on the propane fuel container.

Conventional propane lanterns are powered by propane fuel contained under pressure in propane cylinders or containers, commonly called bottles, which can be either of the throw-away type or the larger, refillable type. The lanterns are generally connected directly to throw-away propane bottles, and a simple on-off needle valve is used to regulate and stop the flow of fuel. However, since the pressure within the propane bottle varies with changes in temperature, the flow of fuel through the on-off valve will also vary, particularly during the last hour or so of life of the propane container when the lantern may burn with a dim glow. The temperature of the propane within the bottle, and therefore its pressure, may change because of changes in ambient temperature, or the temperature of the propane may decrease as the propane flows from the bottle to the lantern. Because the pressure of the propane may be relatively high, the fuel orifice in the burner assembly through which the propane flows is usually relatively small, for example, of the order of 0.001 inch, and this small orifice is subject to clogging. Another problem with on-off needle valves is that it is difficult to accurately control the flow of fuel through the valve because such a valve has a relatively small adjustment range between fully open and fully closed positions. For example, a typical needle valve may move between fully open and fully closed positions by rotation through only about 10°.

When a larger refillable bottle is used and is connected to the lantern by a fuel hose, a regulator may be attached to the end of the hose near the propane container. A separate on-off needle valve and a separate regulator are thus used.

SUMMARY

The invention uses a pressure regulator as both a regulator and an on-off valve, and the regulator-valve is connected to the base of the lantern so that the lantern and regulator-valve can be connected directly to, and supported by, the propane bottle. The rate of fuel flow through the regulator is independent of pressure within the propane container or ambient temperature, and the regulator delivers fuel to the burner assembly of the lantern at a substantially constant rate throughout the life of the propane container until only the last few minutes of the life of the propane container. The adjusting knob of the regulator can be used to adjust the fuel flow and therefore the light output over several turns of the knob compared to the limited adjustment range of a needle valve, and the regulated pressure permits the use of a much larger fuel orifice in the burner assembly which is less susceptible to clogging.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
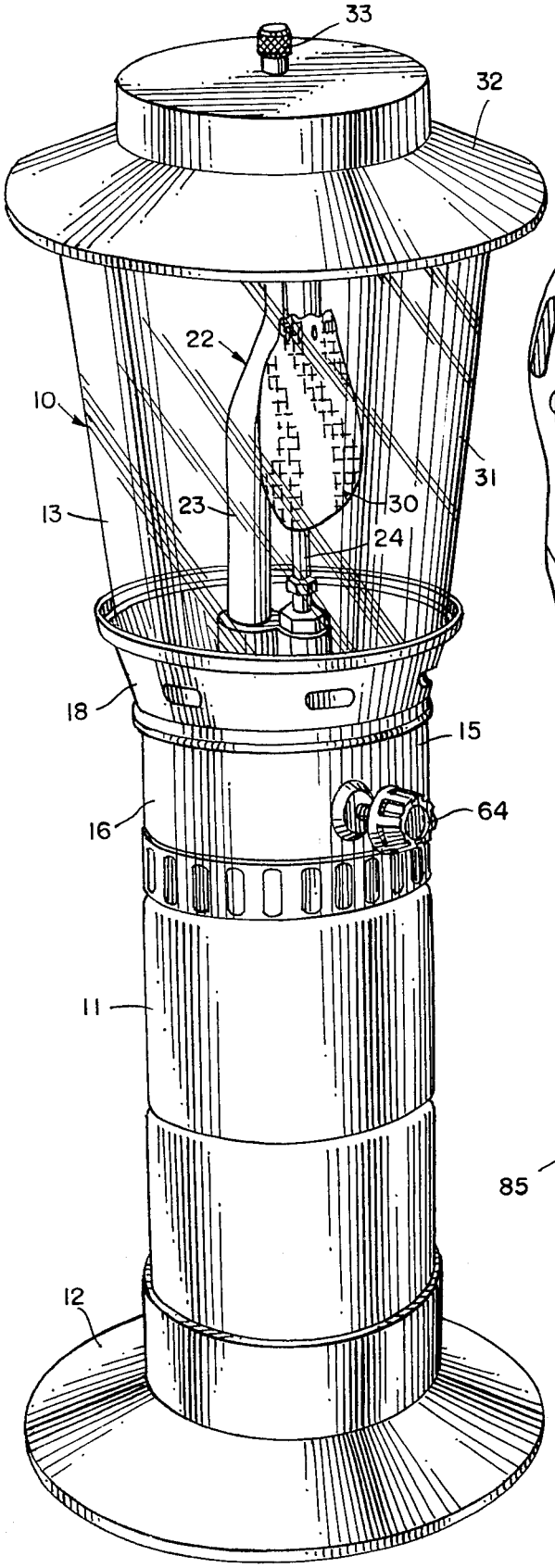
FIG. 1 is a perspective view of a propane lantern mounted on a pressurized propane cylinder.

Referring now to FIGS. 1–4, the numeral 10 designates a lantern and regulator assembly which is mounted on a conventional throw-away metal propane cylinder or bottle 11. The propane bottle is in turn inserted into a base or stand 12 to provide increased stability. The lantern assembly includes a propane lantern 13 and a pressure regulator-valve 14 which is secured to the lantern and supports the lantern on the propane bottle.

The lantern includes a generally cylindrical bottom frame or base 15 having a cylindrical side wall 16, a bottom plate 17, and a generally frusto-conical upper wall 18 which terminates in a globe-supporting shoulder 19 having a generally L-shaped cross section. A top plate 20 extends within the frusto-conical side wall 18 slightly above the bottom wall 17, and an internally threaded nipple 21 on the regulator-valve extends upwardly through an opening in the bottom wall 17 to the top wall 20.

A conventional burner assembly 22 extends upwardly from the top wall 20 and includes an air intake tube 23 and a fuel tube 24. The fuel tube includes inner and outer tubes 25 and 26 and an externally threaded nut 27 which is screwed into an extension fitting 28 which is externally threaded at **28*a* and 28*b*. The threads 28*a* of the fitting and the threaded end of the air intake tube are screwed into a mounting bushing 29 having a pair of internally threaded bores 29*a* and 29*b*. The fitting 28 extends through the top plate 20 and the threads 28*b* are screwed into the nipple 21 of the regulator-valve. The mounting bushing and the regulator-valve are thereby drawn tightly against the top plate 20, and the bore 28*b* is positioned above an air opening 20*a*** in the top plate.

The upper end of the inner fuel tube 25 extends through an offset portion **23*a* in the air intake tube, and the upper end of the outer tube 26 terminates at the outer wall of the offset portion 23*a*. The upper end of the tube 25 is provided with a fuel orifice 25*a* (FIG. 3) through which fuel flows into the air intake tube, and the fuel mixed with air is conveyed by the burner assembly to mantles 20** for combustion.

A frusto-conical transparent globe 31 is supported by the shoulder 19 of the lantern base, and a ventilator or cover 32 is mounted above the glove and secured to the burner assembly by a nut 33 which is screwed onto a bolt 34 which extends through the ventilator.

Figure 6:
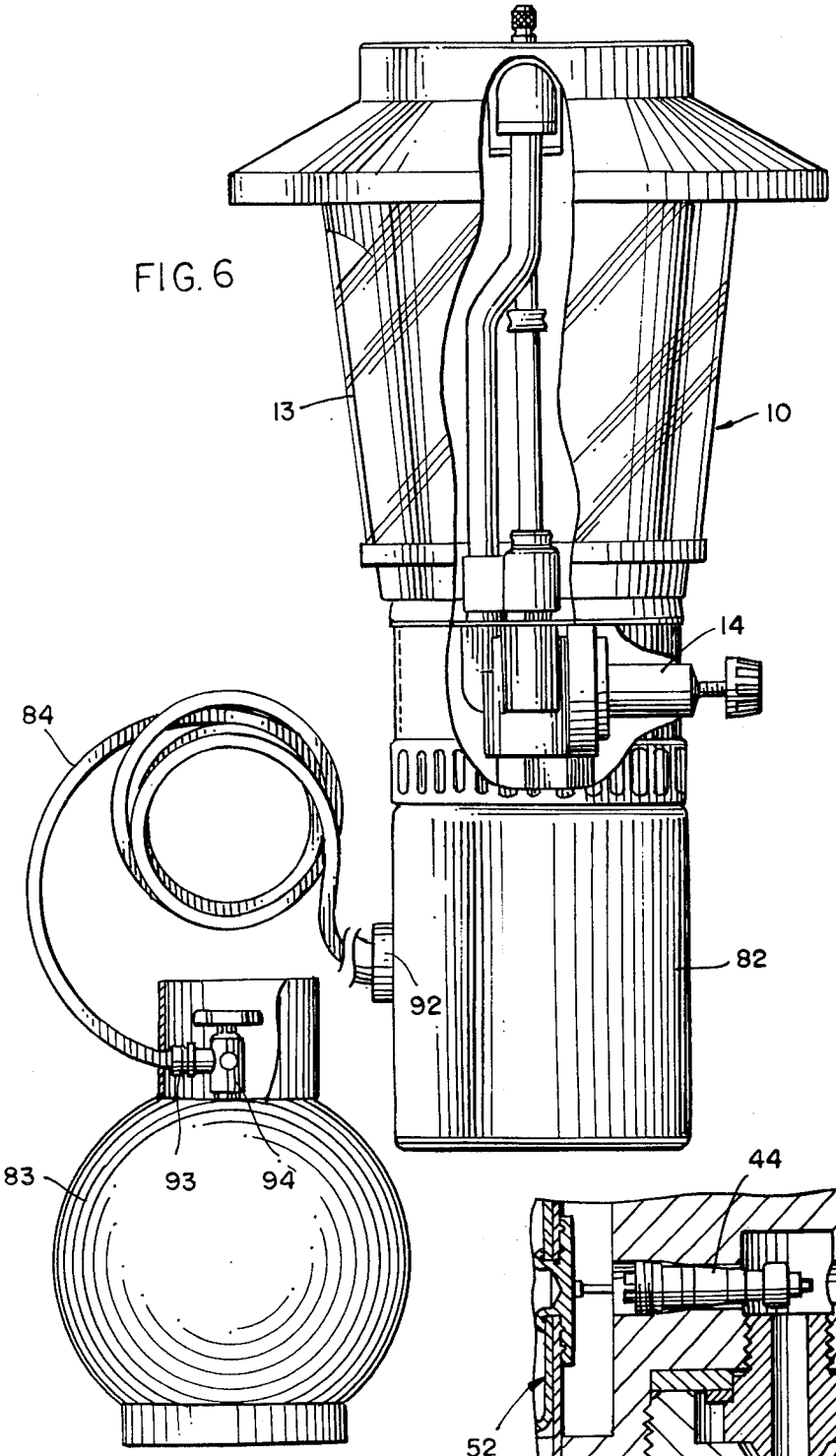
FIG. 6 is an elevational view of the lantern mounted on the adaptor and connected to a refillable propane container.
Figure 8:
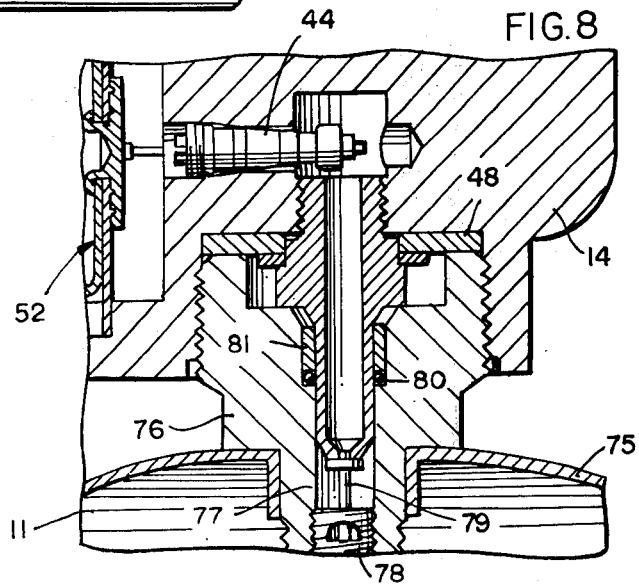
FIG. 8 is a view similar to FIG. 7 showing the regulator-valve connected to the cylinder.
Figure 7:
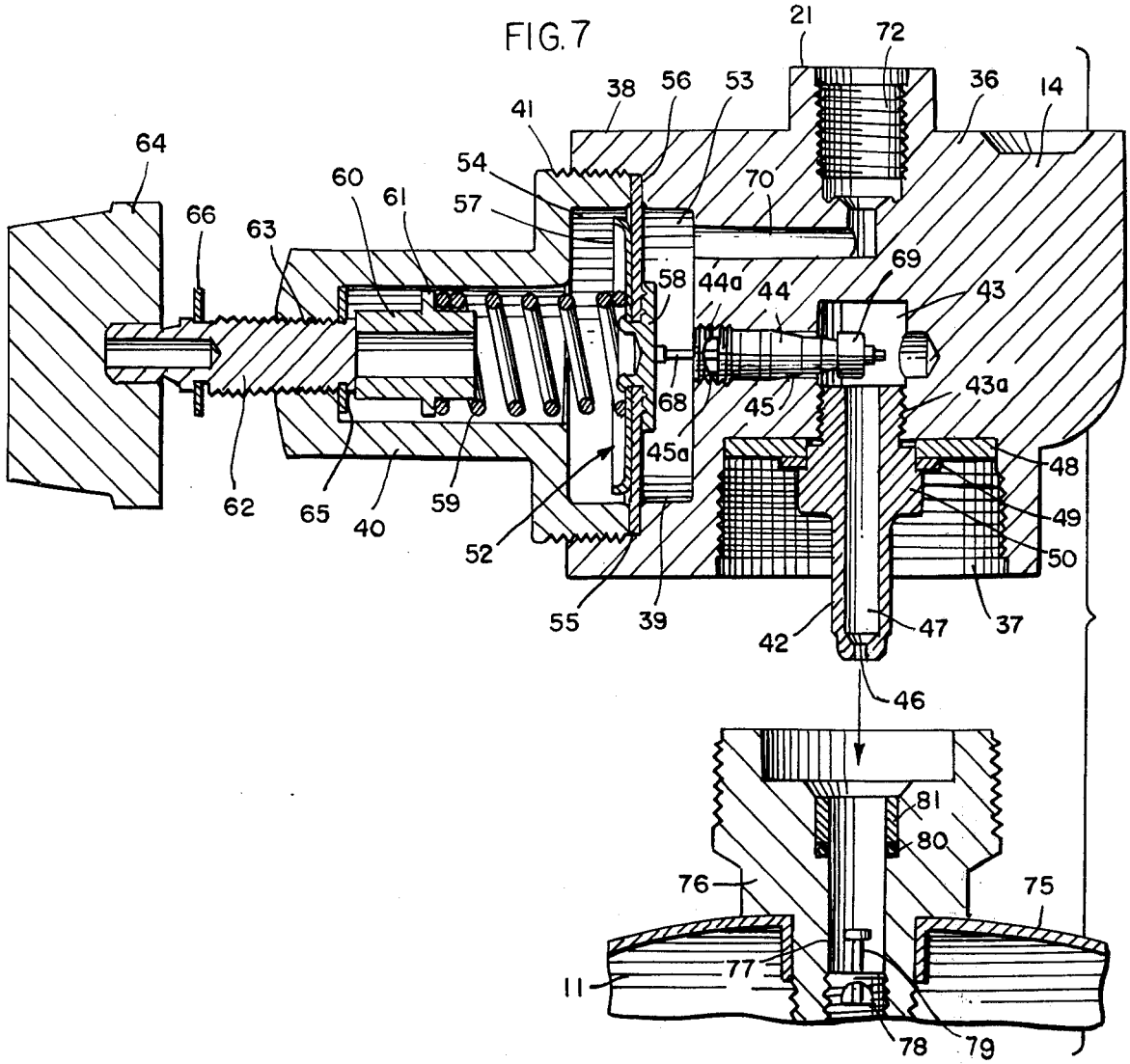
FIG. 7 is an exploded fragmentary sectional view of the pressure regulator-valve and a propane cylinder.

Referring now to FIG. 6, the regulator-valve 14 includes a regulator body or housing 36 which is provided with an internally threaded cylindical recess 37 and an internally threaded collar 38 having a recess 39 extending generally perpendicularly to the threaded recess 37. A generally cylindrical spring cage 40 is secured to the regulator body by an attaching portion 41 which is screwed into the recess 39.

A bottle probe 42 is screwed into an internally threaded recess 43 of reduced diameter which extends inwardly from the recess 37 and which has a threaded portion 43*a*. A conventional valve core 44 of the type commonly used in tire valves is positioned within a recess 45 which extends inwardly from the recess 39 and which communicates with the recess 43. The valve core includes the usual threaded attaching portion 44*a* which is screwed into a threaded portion 45*a* of the bore 45. The lower end of the bottle probe 42 is provided with an orifice 46 which opens into a central longitudinally extending passage 47 within the probe. An annular gasket 48 surrounds the probe and is held in place by an annular gasket retainer or washer 49 engaged by a shoulder 50 on the probe.

A diaphragm assembly 52 is mounted within the recess 39 and provides a pair of chambers 53 and 54 to the right and left, respectively, of the diaphragm assembly. The diaphragm assembly includes a flexible diaphragm 55 which is mounted between the inner end of the attaching portion 41 of the spring cage and a radially inwardly extending shoulder 56 on the collar 38, a spring plate 57, and a valve depressor 58 which extends through the diaphragm and the spring plate and holds them together. A helical compression spring 59 engages the spring plate 57 and is held in place by a sleeve 60 which is provided with a radially outwardly extending spring-retaining rib 61. A screw 62 is threadedly engaged with an internally threaded opening 63 in the spring cage 40, and an adjusting knob 64 is mounted on the outer end of the screw. An E-ring 65 is mounted in a groove in the inner end of the screw 62, and an E-ring 66 is mounted in a groove in the external portion of the screw to provide positive stops as the screw moves into and out of the spring cage.

The regulator-valve is shown in the closed position in FIG. 6, and the spring depressor 58 of the diaphragm assembly permits the spring-biased valve stem 68 of the valve core 44 to extend to its outermost position to permit the resilient valve closure member 69 to seat and close the valve core. When it is desired to open the regulator-valve, the adjusting knob 64 is rotated to advance the screw 62 into the spring cage, thereby pushing the spring sleeve 60 to the right and forcing the diaphragm assembly to depress the stem 68 of the valve core and to unseat the valve closure 69. Fuel may therefore flow through the probe 42, the recess 43, and the valve core into the chamber 53 and thereafter through a fuel passage 70 and into the internally threaded recess 72 of the nipple 21.

Referring now to the lower portion of FIG. 6, the propane bottle 11 is conventional and includes a generally cylindrical metal body 75 and an externally threaded fitting or bushing 76 extending from the top of the body. The bushing is provided with a central bore 77 in which a conventional valve core 78 having a valve stem 79 is mounted for maintaining the bore normally closed. An O-ring 80 is held in the bore by a retaining sleeve 81.

When the lantern is to be used, the lantern and regulator assembly is mounted on the bottle by screwing the fitting 76 into the internally threaded recess 37 of the regulator-valve. As the probe 42 of the regulator advances into the recess of the fitting 76, the O-ring 80 seals against the probe and the probe engages and depresses the valve stem 79 to open the valve 78. The upper end of the fitting 76 engages the gasket 48 which cushions and protects the fitting, and hand tightening of the fitting within the recess of the regulator will provide an effective gas-tight seal. Preferably, the screw 62 of the regulator-valve is in the off position illustrated in FIG. 6 when the lantern and regulator assembly is mounted on the propane bottle so that even though the valve 78 is open, fuel is prevented from flowing to the lantern by the valve core 44 of the regulator-valve.

When it is desired to light the lantern, the adjusting knob 64 can be rotated to open the valve core 44 while a lighted match is held below the mantles 26. The adjusting knob is preferably turned to its fully open position in which the E-ring 66 engages the outer end of the spring cage 40 during the lighting procedure. After the mantles are lighted, the adjusting knob can be backed off if desired from the full open position to adjust the fuel flow through the valve core 44 to provide the desired brightness.

The diaphragm assembly 52 operates in the conventional manner to maintain the rate of fuel flow from the regulator to the fuel tube 24 substantially constant and independent of pressure within the bottle. The pressure within the propane bottle is maintained in the chamber 53 on the right side of the diaphragm 55, and atmospheric pressure is maintained in the chamber 54 on the left side of the diaphragm. The spring pressure on the diaphragm can be adjusted as desired by the regulating knob 64 and the screw 62. If the pressure within the propane bottle decreases and exerts a smaller force on the diaphragm than the spring, the diaphragm will move to the right, thereby further depressing the valve stem 68 and opening the valve core. Conversely, if the pressure within the cylinder increases and exerts a greater pressure on the diaphragm than the spring, the diaphragm will move to the left, thereby permitting the valve stem 68 to extend and causing the passage through the valve core to close or become more restricted. While the lantern is operating, the valve stem of the valve core may actually hunt, i.e., oscillate between open and closed positions, under the influence of the bottle pressure acting on the spring-biased diaphragm. The pressure of the propane which flows from the regulator-valve to the lantern is thereby maintained at a desired level.

When it is desired to extinguish the lantern, the adjusting knob is rotated to withdraw the screw 62 until the E-ring stop 65 abuts the spring cage as shown in FIG. 6. The pitch of the screw 62 is such that the adjusting knob may be rotated through at least one full turn from the fully closed to the fully opened position, and in the specific embodiment illustrated the knob can be rotated through about 2 ½ to 3 turns. The regulator-valve can therefore be adjusted over a very wide range.

The pressure of the propane within the bottle may vary widely because of changes in ambient temperature. The propane fuel is maintained as a liquid within the bottle under its own vapor pressure, and the vapor pressure of propane at a particular temperature is well known. For example, the pressure at 110°F. is about 204 psi, and the pressure at 30°F. is about 50 psi. Accordingly, if the pressure is not regulated, propane would flow to the lantern under very high pressure on hot days and under relatively low pressure on cold days. The lantern would thus burn very brightly on hot days and might not even consume all of the fuel being supplied to the mantles and would burn dimly on cold days.

The conventional needle valve that is commonly used on propane lanterns cannot be used to regulate or control the flow of propane to the burner assembly because the needle moves only a small amount between its fully open and fully closed positions. The fuel tube which supplies the propane to the burner assembly is therefore provided with a small orifice, commonly of the order of 0.001 inch, to limit the flow of propane when the pressure is relatively high. However, an orifice of this size is subject to clogging by foreign particles within the lantern or the fuel.

In contrast to conventional lanterns, the invention permits the pressure of the propane which is supplied to the burner assembly to be maintained at a desired level regardless of the temperature of the propane within the bottle. I have found that during normal operation a pressure of about 15 psi in the fuel tube is advantageous, and because of this relatively low pressure, the size of the fuel orifice 25*a* can be increased to within a range of about 0.005 inch to about 0.015 inch. I have had particularly good results with orifices having diameters of between about 0.008 and 0.010 inch. If more or less fuel is to be supplied to the mantles to provide more or less light, the pressure of the propane can be increased or decreased accordingly by rotating the adjusting knob.

Figure 4:
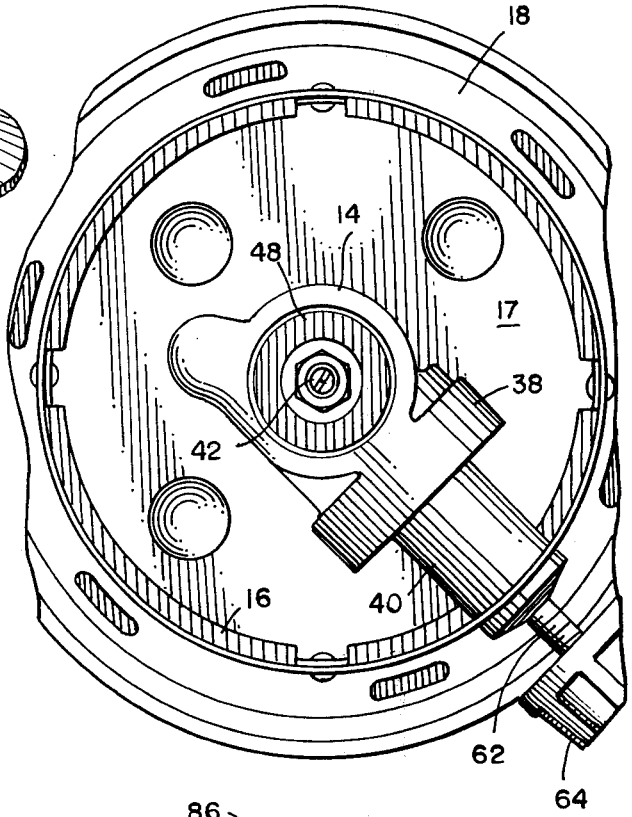
FIG. 4 is a fragmentary bottom plan view taken along the line 4—4 of FIG. 2.
Figure 5:
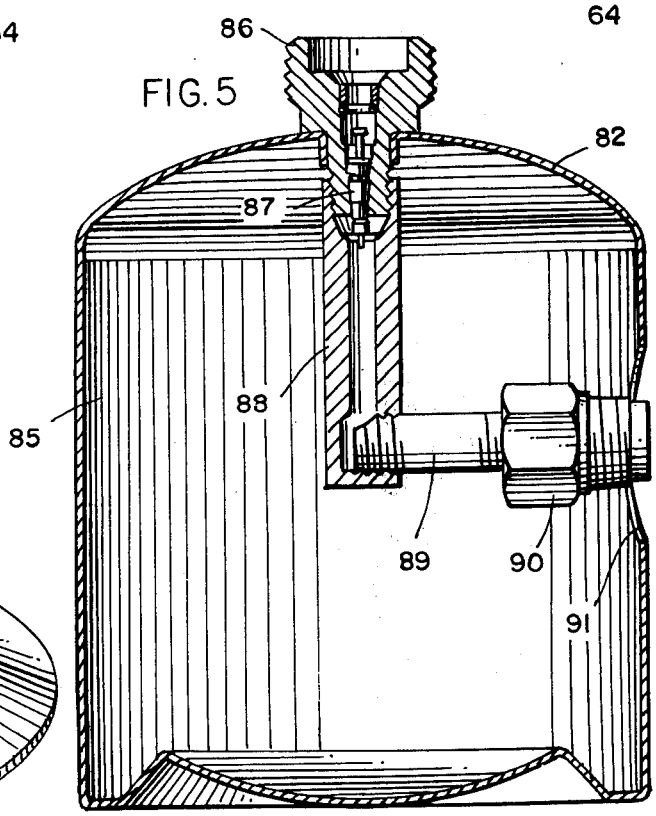
FIG. 5 is a sectional elevational view of an adaptor for use with a refillable propane container.
Figures 2, 3:
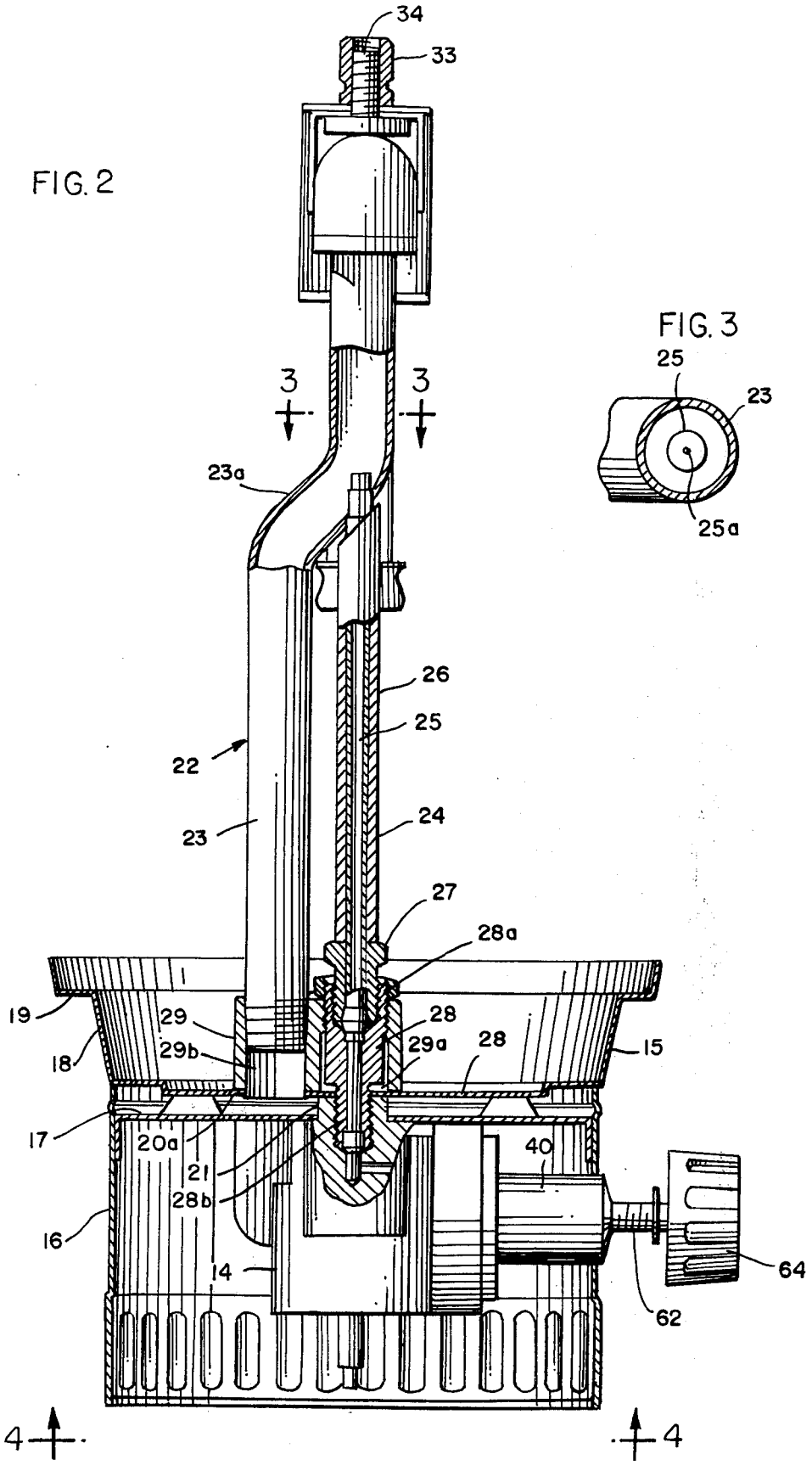
FIG. 2 is an enlarged view, partially broken away, of a portion of the propane lantern.
FIG. 3 is a fragmentary sectional view taken along the line 3—3 of FIG. 2.

The lantern regulator assembly can also be connected to a bulk or refillable propane bottle by using a suitable adaptor for supporting the lantern regulator assembly. Referring to FIGS. 4 and 5, the lantern assembly 10 is supported by an adaptor 82 and is connected to a large refillable propane bottle 83 by a flexible hose 84. The adaptor 82 includes a generally cylindrical base 85 which may be similar to the body of a conventional throw-away propane bottle and a standard externally threaded fitting 86 identical to the fitting 76 of the propane bottle 11. The fitting 86 is also provided with a valve core 87, and the inner end of the fitting is connected to a downwardly extending pipe 88 and an outwardly extending pipe 89. An externally threaded fitting 90 is connected to the pipe 89 and is accessible through an opening 91 provided through the cylindrical wall of the adaptor. The connecting hose 84 includes a female coupler fitting 92 on one end thereof which is connected to the fitting 90 and a male fitting 93 on the other end which may be connected to a conventional POL valve 94 on the propane bottle. The adaptor 82 serves merely to support the lantern-regulator assembly and to connect the fuel hose to the regulator-valve, and the propane fuel is supplied by the propane bottle 83. Since the flow of fuel from the propane bottle can be stopped by closing the POL valve 94, the adaptor 82 could be provided without the valve core 87. However, the valve core provides added safety in the event that the lantern assembly is unscrewed from the adaptor before the POL valve is closed.

The refillable propane bottle 83 may typically have a capacity of about 11 pounds. Even though the refillable bottle has a much larger capacity than the throw-away cylinder 11, which may have a capacity of the order of about 14 to 16 ounces, the regulator maintains the flow of fuel to the mantles substantially constant throughout the life of the bottle for any particular setting of the regulator-valve. The flow rate begins to decrease only during about the last 5 or 10 minutes of bottle life.

While in the foregoing specification, a detailed description of a specific embodiment of the invention was set forth for the purpose of illustration, it is to be understood that many of the details hereingiven may be varied considerably by those skilled in the art without departing from the spirit and scope of the invention.

I claim:

1. In combination, a propane lantern and a pressure regulator assembly adapted to be connected to a source of pressurized propane fuel provided with an externally threaded fitting, said fitting defining a central bore communicating with said source and carrying a valve; the lantern having a base and a burner assembly extending above said base, the pressure regulator assembly comprising a housing defining a threaded connection receiving said burner assembly and an internally threaded recess for coupling to said threaded fitting of said source; a bottle probe carried by said housing and extending within said internally threaded recess thereof to engage and open said source valve when said pressure regulator assembly is assembled thereto, said probe defining a flow controlling orifice and a passage communicating said orifice with the interior of said housing; valve means in said housing communicating with said passage of said probe and including a core secured to said housing, a movable stem slidably received in said core and spring-biased to a closed position, and a resilient closure member carried by said stem for continuously controlled adjusting movement between a closed position at which said resilient member engages and seals said core and an opened position at which said resilient member disengages said core, positions of said resilient member intermediate said closed and opened positions adjustably controlling the flow of gas from said probe; and pressure regulator means carried by said housing and comprising flexible diaphragm means engaging said stem of said valve means; main spring means engaging said diaphragm means and urging the same to open said valve means; control means having an inner end portion with a flange end engaging said main spring means to controllably compress the same, and a continuously externally threaded portion threadedly received in said housing for controlled rotation over a plurality of turns whereby rotation of said control means member in one direction moves the inner end thereof toward said diaphragm means to increase the compression of said main spring against said diaphragm means and to open the valve means, and rotation of said control means in the other direction moves the inner end thereof away from said diaphragm means to decrease the compression of said main spring against said diaphragm means to permit the valve means to close, said valve means being movable between the closed and fully open positions by rotation of the control means through at least a plurality of turns; and passage means in said housing at least partially defined by the side of said diaphragm means not engaging said main spring means for communicating gas passing through said valve means to said threaded connection receiving said burner assembly, whereby the pressure of gas passing through said valve means to said turner assembly is regulated and may be continuously adjusted over a range defined by said plurality of turns through which said control means may be rotated to adjust the compression of said main spring against said diaphragm means, said control means extending beyond said housing and defining a first groove at one end of said threaded portion external of said housing and a second groove within said housing at the other end of said threaded portion, said combination further comprising first and second spacer means received respectively in said grooves of said control means to engage said housing to limit the insertion and retraction of said control means; and a knob on said control means beyond said first groove to turn said control means by hand.

* * * * *